United States Patent [19]

Green

[11] Patent Number: 4,716,914

[45] Date of Patent: Jan. 5, 1988

[54] HAIR STYLING BONNET

[76] Inventor: Laura Green, 8242 Old Ranch Rd., Citrus Heights, Calif. 95610

[21] Appl. No.: 862,465

[22] Filed: May 12, 1986

[51] Int. Cl.[4] ..... A45D 8/40

[52] U.S. Cl. ..... 132/9; 132/7

[58] Field of Search ..... 132/7, 9, 45 R, 49; 2/2, 410, 68

[56] References Cited

U.S. PATENT DOCUMENTS

| | | | |
|---|---|---|---|
| 2,781,764 | 2/1957 | Miller | 132/9 |
| 3,138,801 | 6/1964 | Brodsky | 2/68 |
| 3,274,612 | 9/1966 | Merriam | 2/68 |
| 3,778,846 | 12/1973 | Norie | 2/68 |
| 3,916,917 | 11/1973 | Hubbert | 132/9 |
| 3,972,075 | 8/1976 | Alevras | 132/45 R |
| 4,155,369 | 5/1979 | Guinan | 132/9 |
| 4,269,850 | 5/1981 | Barrett | 132/9 |
| 4,357,951 | 11/1982 | Aricco | 132/9 |

*Primary Examiner*—Robert P. Swiatek
*Assistant Examiner*—J. Hakomaki
*Attorney, Agent, or Firm*—Mark C. Jacobs

[57] ABSTRACT

A perforated bonnet to be placed on the head of a person after the roller rods used in applying a permanent wave are disposed upon the hair such that the rinse and neutralizing solution can be applied.

3 Claims, 3 Drawing Figures

HAIR STYLING BONNET

BACKGROUND OF THE INVENTION

The application of "permanent wave" solutions to achieve hair curl is a process that enjoys great popularity among women and today, even among men. The process has become easier since after World War II with the advent of the home permanent kits.

One of the problems associated with permanent waves, is the fact that the curling aids which are held under pressure tend to come loose. Thus the necessity has arisen for the placement of a cap upon the head to hold the curling rods in proper disposition. Problems arise however when it becomes necessary to rinse and neutralize, as upon removal of the bonnet or cap, the curling rods can come loose.

PRIOR ART

There have been hair treatment caps identified in the art.

The references know to the applicant includes:

| Patent # | Applicant | Date |
|---|---|---|
| 3,249,113 | Sobeck | 5-3-66 |
| 3,302,653 | D'Agostino | 2-7-67 |
| 3,972,075 | Alevras | 8-3-76 |
| 3,159,466 | Nissman | 12-1-64 |
| 2,781,764 | Miller | 2-19-57 |
| 3,197,787 | Tognan et al | 8-3-65 |

Sobeck discloses a frosting cap which can be perforated as desired by a pointed object such as a crochet needle. It is not possible however to rinse the scalp using this bonnet.

D'Agostino amplifies this theme with a dual cap throw away system. Perforations my be formed by a crochet needle.

Alevras suggests a cap having openings therein but not for the intended purpose. Also the openings are strategically disposed for the purpose of the unit.

Nissman has a bonnet adapted to receive a blower which delivers air from an air source to dry the hair. A series of perforations are provided at few locals to permit the steam to escape.

The other references not discussed were not reviewed in depth.

There is a need therefore for a new bonnet or cap that will permit the best of both worlds; namely curling rod retention and easy rinsing and neutralization.

It is an object therefore of this invention to provide such a bonnet that may be readily used by those in the trade, as well as by do it yourselfers.

It is another object to provide a perforated bonnet that holds the curling rods in place, yet permits easy rising and neutralization of the hair.

These and other objects of the invention will in part be obvious and will in part appear hereinafter.

The invention accordingly comprises the product possessing the features, properties and the relation of elements and the several steps and the relation and order of use or more of such steps with respect to each of the other, all of which are exemplified in the following detailed disclosure, and the scope of the application of which will be indicated in the claims.

For a fuller understanding of the nature and objects of the invention, reference should be had to the following detailed description taken in connection with the accompanying drawing.

SUMMARY OF THE INVENTION

A bonnet adapted to fit over the head of the wearer to retain the hair therein while the hair is disposed in permanent wave rods, comprising a flexible cap body having an open bottom, an elastic skirt encircling said open bottom, to engage the hair of the wearer within the cap body while in place in the wave rods, and having a plurality of spaced bores uniformly dispersed around the body, which bores are sized to permit the hair to be rinsed while the bonnet is being worn.

DESCRIPTION OF THE PREFERRED EMBODIMENT

As has been alluded to previously, the invention herein is a cap of flexible material and having an elastic skirt, adapted to cover the head of the wearer while in use. The cap includes a plurality of spaced bores for the purposes to be described below.

Figure 1:
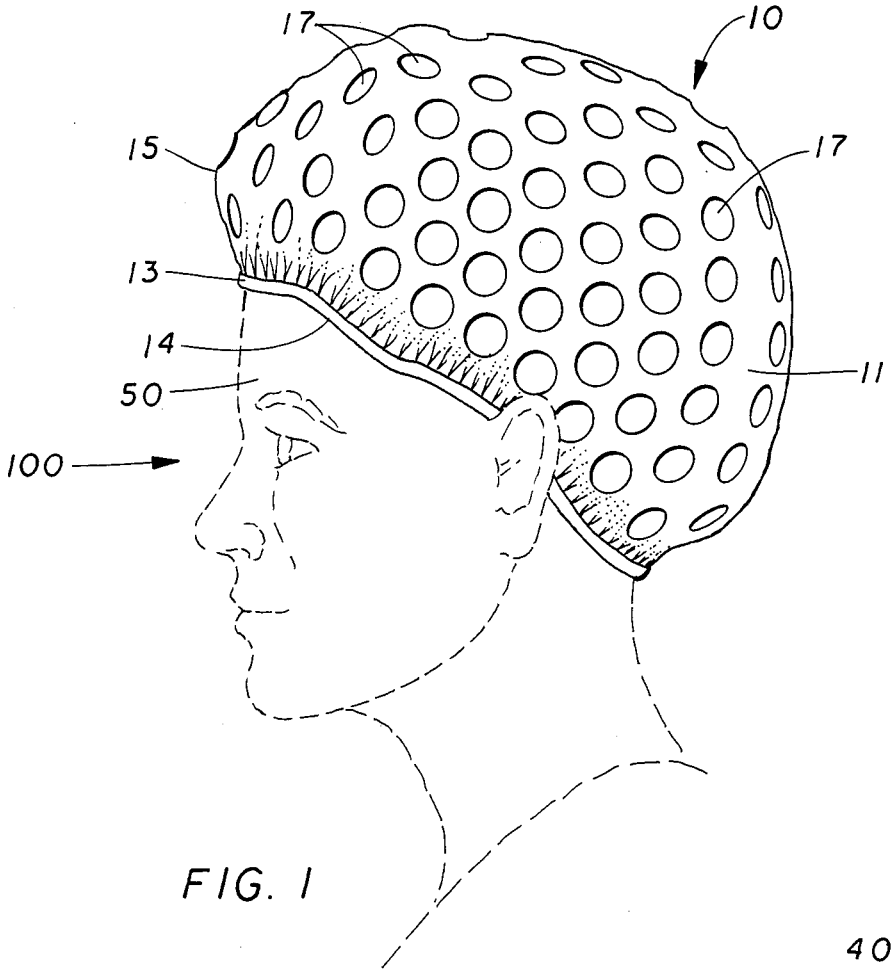
FIG. 1: shows a side view of the hair bonnet upon a user's head.
Figure 2:
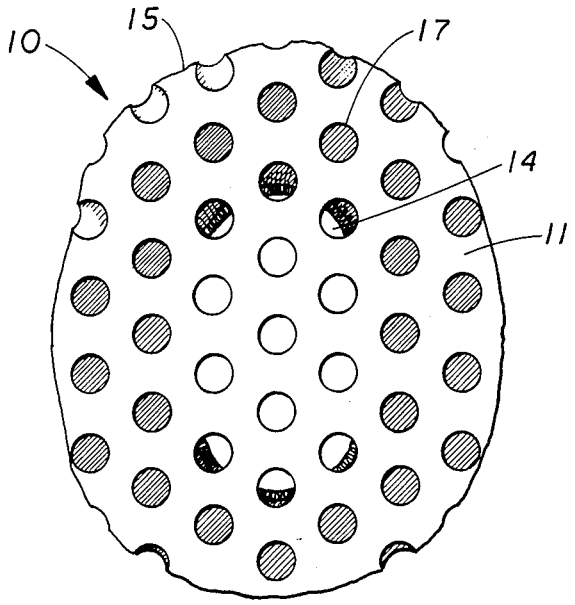
FIG. 2: shows a top view of the bonnet.

Cap 10 shown in FIG. 1 on the head 50 of the wearer includes a flexible main body portion 11; an elastic skirt 13 surrounding a bottom open portion 14, such that the skirt 13 is adapted to encircle the head to retain the wearer's hair thereunder. Spaced around the main body portion are bores 17 which communicate to he hair to permit access thereto. As seen in FIG. 2 the periphery 15 of the body portion is loose and flexible and does not conform to the shape of the head. Thus the head 50 is retained within the hood or cap by the elastic skirt 13. Elastic, binding or retaining means are known in the art and comprise an elastic band sewn within a hemmed channel. Such retaining means are often used for shower caps.

The bores disposed around the main body of this invention are spaced 1" to 2" apart and may be from about $\frac{1}{2}$" to $\frac{3}{4}$" in diameter. Smaller diameter are not useable as the fluids to be applied to the hair retained with the curlers can not be readily accessed. Diameters larger than $\frac{3}{4}$" would permit the rollers to pop through the cap.

USAGE OF THE CAP

Figure 3:
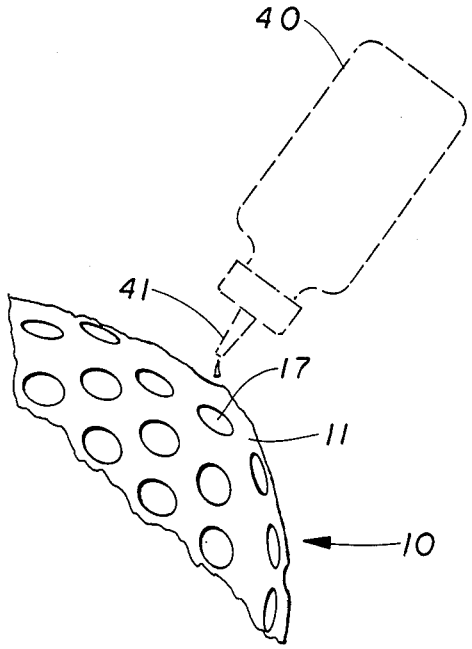
FIG. 3: shows hair fluid being applied through apertures in the hair bonnet.

As has been mentioned earlier, the device of this invention is placed over the hair after the permanent wave solution has been applied to the hair and the hair set in rollers. With the cap in place, the operator or the do-it-yourselfer squirts rinse water and optionally the neutralizing liquid onto the bound up "curls" via the bore or port 17 in the bonnet 10, using a bottle 40 having an applicator tip 41 as shown in FIG. 3. The neutralizing solutions is squirted on through the bores in bonnet 10 using a bottle having an application tip, such that the solution is directed to a narrow zone of the hair. Such application bottles are readily available in the marketplace.

After the application of the neutralizer, water or another rinse can also be applied to the hair, also directly via the bores 17 in the bonnet 10.

One bit benefit of the bonnet of this invention is the fact that it is disposable. After being used on one person's hair it is chucked away such that each person's hair is covered with a new cap. This enhances the sanitary appeal of the device.

For best results we have found that the gauge of plastic should be 0.75 millimeters and the bores about $\frac{3}{4}''$ in diameter.

Another benefit of this invention is the fact that the total time to give a permanent wave is reduced, since it is not necessary to constantly re-apply hair to various rods as they come apart. Here the hair is treated while untouched, i.e. maintained under restraint with in the bonnet. As an extra benefit it is to be seen that the wave rods can be rinsed out with water quickly and easily while still inside the cap. This is done just prior disposal of the cap. Thus the cap due to apertures acts as a drain for this rinse water.

It is seen that we have provided a product that significantly reduces the time it takes to accomplish the permanent waving of hair. The product is easy to use and low in cost.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. In the process of permanently waving the hair of a human wherein a waving solution is applied to the hair, which comprises the steps of a. placing the hair in curling rods, b. placing a flexible perforated bonnet having perforations of about $\frac{1}{2}$ inch in diameter, said perforations being spaced about the bonnet, over substantially all of the hair of the wearer to aid in the retention of the hair within the curling rods, c. rinsing the hair with the perforated bonnet in place over the curl rods.

2. In the process of claim 1 including th additional step of neutralizing the hair with the perforated bonnet in place.

3. A bonnet to be used during the process of permanent waving the human hair for the application of solutions therethrough, and to hold the permanent wave curl rods in place while rinsing and neutralizing the hair through said bonnet, which bonnet comprises:

a flexible cap body portion open at the bottom, and having an elastic skirt encircling the bottom to frictionally engage the wearer's head, which cap body covers substantially all of the hair, and the permanent wave curl rods disposed in the hair during a permanent wave treatment, said cap body portion having a plurality of spaced bores therein, said bores disposed substantially uniformly around the entire cap body portion, said bores sized approximately $\frac{1}{2}$ to $\frac{3}{4}$ inches in diameter and being uniformly spaced about 1 inch apart to thereby permit treating of the hair in the curl rods while the bonnet is worn, wherein said cap body portion is made of a plastic film.

* * * * *